US005310639A

United States Patent [19]

Lushington et al.

[11] Patent Number: 5,310,639

[45] Date of Patent: May 10, 1994

[54] PHOTOGRAPHIC ELEMENT CONTAINING STRESS ABSORBING INTERMEDIATE LAYER

[75] Inventors: Kenneth J. Lushington; Richard P. Szajewski, both of Rochester; Kevin M. O'Connor, Webster, all of N.Y.

[73] Assignee: Eastman Kodak Company, Rochester, N.Y.

[21] Appl. No.: 21,382

[22] Filed: Feb. 23, 1993

Related U.S. Application Data

[63] Continuation of Ser. No. 720,359, Jun. 25, 1991, abandoned.

[51] Int. Cl.[5] ..... G03C 1/76

[52] U.S. Cl. ..... 430/539; 430/523; 430/536

[58] Field of Search ..... 430/523, 536, 539

[56] References Cited

U.S. PATENT DOCUMENTS

| | | | |
|---|---|---|---|
| 3,576,628 | 4/1971 | Beavers et al. | 96/29 |
| 3,791,857 | 2/1974 | Balle et al. | 117/161 |
| 4,232,117 | 11/1980 | Naoi et al. | 430/539 |
| 4,245,036 | 1/1981 | De Winter et al. | 430/510 |
| 4,247,627 | 1/1981 | Chen | 430/512 |
| 4,399,213 | 8/1983 | Watanabe et al. | 430/523 |
| 4,464,462 | 8/1984 | Sugimoto et al. | 430/512 |
| 4,499,179 | 2/1985 | Ota et al. | 430/523 |
| 4,551,412 | 11/1985 | Ogawa et al. | 430/265 |
| 4,766,059 | 8/1988 | Vandenabeele et al. | 430/531 |
| 4,777,113 | 10/1988 | Inoue et al. | 430/264 |
| 4,800,150 | 1/1989 | Katoh | 430/264 |
| 4,822,727 | 4/1989 | Ishigaki et al. | 430/536 |
| 4,840,881 | 6/1989 | Watanabe et al. | 430/512 |
| 4,855,219 | 8/1989 | Bagchi et al. | 430/496 |
| 4,914,012 | 4/1990 | Kawai | 430/536 |
| 4,920,004 | 4/1990 | Bagchi | 428/407 |
| 4,940,653 | 7/1990 | Lalvani et al. | 430/502 |
| 5,026,632 | 6/1991 | Bagchi et al. | 430/545 |
| 5,061,595 | 10/1991 | Gingello et al. | 430/264 |
| 5,066,572 | 11/1991 | O'Connor et al. | 430/503 |

FOREIGN PATENT DOCUMENTS

| | | |
|---|---|---|
| 0490302 | 6/1992 | European Pat. Off. . |
| 1-61748 | 3/1989 | Japan . |
| 1-267638 | 10/1989 | Japan . |
| 1-291251 | 11/1989 | Japan . |

*Primary Examiner*—Jack P. Brammer

*Attorney, Agent, or Firm*—Andrew J. Anderson

[57] ABSTRACT

A light sensitive photographic element is disclosed having a support bearing at least one light sensitive silver halide emulsion layer and at least one non-light sensitive stress absorbing layer between the emulsion layer and the support, wherein the stress absorbing layer comprises a polymer and a hydrophilic colloid in a mass ratio of greater than or equal to about 1:2, the polymer having a glass transition temperature of less than about 5° C. It has been found that pressure fog can be substantially reduced while maintaining scratch resistence when such a stress absorbing layer is present.

9 Claims, No Drawings

PHOTOGRAPHIC ELEMENT CONTAINING STRESS ABSORBING INTERMEDIATE LAYER

This is a continuation of application Ser. No. 07/720,359, filed Jun. 25, 1991 now abandoned.

This invention is related to concurrently filed, copending, commonly assigned U.S. Ser. No. 07/720,360 of Lushington et al. entitled "Photographic Element Containing Stress Absorbing Protective Layer," and copending, commonly assigned U.S. Ser. Nos. 497,472 of Bagchi et al. and 497,456 of O'Connor et al., both filed Mar. 22, 1990, now U.S. Pat. Nos. 5,026,632 and 5,066,572, the disclosures of which are incorporated by reference.

TECHNICAL FIELD

The present invention relates to photographic materials and more particularly to new silver halide photographic materials which are less susceptible to pressure fog.

BACKGROUND ART

Pressure applied to silver halide photographic emulsion coatings can produce both reversible and irreversible effects on the sensitometry of the photographic product. Various types of pressure effects on silver halide photographic systems have been known for long periods of time. In general, pressure sensitivity can be described as an effect which causes the photographic sensitometry of film products to change after the application of some kind of a mechanical stress to a coated photographic film. Sufficient pressure can cause irreversible distortion of the emulsion grains or cause the formation of physical defects that alter the sensitivity for latent image formation. The prior art, such as described in James, *The Theory of the Photographic Process*, 4th Ed., MacMillan (1977), describe various mechanisms in association with the various types of pressure sensitivities observed with photographic products, wherein the transmission of mechanical and thermal stress to silver halide crystals cause a change in sensitometry for the photographic products.

Pressure sensitivity may manifest itself in photographic products in the form of pressure desensitization or pressure fog, resulting in decreased or increased density marks, respectively, after development. Pressure fog, which is often called photoabrasion, is an increasingly large impediment to the manufacture and use of photographic recording materials. The problem is generally believed to arise from large local stresses applied to the recording materials when small particles of dirt on transport mechanism rollers are pressed against the materials in cameras or other exposing devises or possibly during processing operations.

Attempts to control this problem include use of gelatin overcoat layers. Such layers, however, even if relatively thick as disclosed in Japanese Kokais 01-267638(1989) and 01-291251(1989), do not offer adequate protection themselves. Dry gelatin is hard and can thus easily transmit applied stress to the silver halide crystals in a coated photographic system. Japanese Kokai 01-61748(1989) discloses the use of protective overcoat layers containing colloidal silica and an ester on photographic elements in order to improve pressure fog resistance, and discloses that synthetic polymer latexes may be present in the emulsion or other layers of the photographic elements. U.S. Pat. No. 4,464,462 discloses that the presense of an ultraviolet ray absorbing polymer latex in a photographic element does not have an adverse influence on fog, but there is no teaching that the occurance of pressure fog is decreased by its presense.

The prior art also describes the inclusion of polymer latexes into coated emulsion layers to decrease pressure desensitization in photographic products as disclosed in U.S. Pat. No.3,576,628, to distribute hydrophobic addenda in a hydrophilic colloid layer as disclosed in U.S. Pat. No. 4,247,627, and as plasticizers for gelatin as described, for example, in U.S. Pat. No. 4,245,036. While the inclusion of polymer latexes in emulsion layers may help reduce pressure desensitization problems, this approach has generally caused an increase in the pressure fog problem. The prior art also describes in U.S. Pat. Nos. 4,551,412 and 4,822,727 the use of polymer latexes having glass transition temperatures of both above 20° C. and below 20° C. in overcoat layers in order to decrease brittleness and reticulation while improving sticking resistance in photographic elements. Similarly, the prior art describes the use of organic solvent dispersions in photographic silver halide emulsion and overcoat layers as disclosed in U.S. Pat. Nos. 4,840,881, 4,499,179, and 4,399,213.

In general, pressure sensitivity problems increase with the physical size of the emulsion crystals. Its manifestation is most severe in the high aspect ratio highly deformable "Tabular Grain Emulsions," used in many current photographic products and extensively described in prior art. There is, therefore, a need to produce photographic elements that are less sensitive to mechanical stress in order to improve the quality of many of today's current photographic products. It would be desirable to reduce pressure fog in such photographic products without detrimentally affecting other photographic qualities, and while retaining good scratch resistance for photographic elements.

SUMMARY OF THE INVENTION

These and other objects of the invention are achieved in accordance with the invention, which comprises a light sensitive photographic element comprising a support bearing at least one light sensitive silver halide emulsion layer and at least one non-light sensitive stress absorbing layer between the emulsion layer and the support, wherein the stress absorbing layer comprises a polymer and a hydrophilic colloid in a mass ratio of greater than or equal to about 1:2, the polymer having a glass transition temperature of less than about 5° C. It has been found that pressure fog in photographic elements can be substantially reduced when such a stress absorbing layer is present, and that the scratch resistance of such elements is not detrimentally affected.

MODES FOR CARRYING OUT THE INVENTION

Through experimental analysis, applicants have discovered that a main factor in the generation of pressure fog is the level of anisotropic stress that reaches an emulsion layer due to the application of localized pressure, especially the in-plane shear stress. Applicants have surprisingly found that the level of shear stress that is transmitted to an emulsion layer from a pressure source can be reduced by the addition of a very soft layer under the emulsion layer. While a conventional gelatin overcoat layer may also be included over the light sensitive emulsion layer, such overcoat layers alone are not sufficient to provide the desired degree of pressure fog resistance. If such very soft layers are simply used as an overcoat layer over emulsion layers of an element, there may be problems due to excessive tackiness of the layer and due to the layer flowing out of the way under compressive stress, leaving the emulsion layers unprotected. The scratch resistance of a photographic element may also be reduced when such a soft layer is used as an overcoat layer. It has surprisingly been found that when such a soft layer is positioned between a silver halide layer and the support of a photographic element, the occurence of pressure fog is reduced while scratch resistence is maintained. This result is surprising as one intuitively would think that a stress absorbing layer should be positioned between the pressure source and the pressure sensitive material in order to be effective.

In addition to maintaining scratch resistence, the invention has numerous advantages over prior processes for minimization of pressure fog. The invention photographic elements having the stress absorbing layer of the invention incorporated therein do not have a tendency to delaminate or emboss as do high solvent containing pressure resistant materials. Further the elements of the invention do not suffer from substantial deterioration in photographic properties. These and other advantages will be apparent from the detailed description below.

From experimental investigation it has been determined that stress absorbing layers comprising a polymer having a glass transition temperature (Tg) of less than about 5° C. are capable of increasing the pressure fog resistance of silver halide emulsions when such polymers are present at a weight ratio of about 1:2 or greater relative to hydrophilic colloid in the stress absorbing layer. The polymer preferably has a glass transition temperature of less than about 0° C. and optimally less than about −15° C.

Such polymers, when coated as a cushioning layer between a support and an emulsion layer in a photographic film, act as a stress absorbing layer and reduce pressure fog problems, especially problems associated with high aspect ratio tabular grain emulsion containing films.

Generally, pressure fog is reduced as the proportion of low Tg polymer to hydrophilic colloid is increased. The low Tg polymer and hydrophilic colloid are present in the stress absorbing layer in a weight ratio of greater than or equal to about 1:2, preferably in the range of from about 1:1 to 10:1, more preferably in the range of from 2:1 to 10:1 and most preferably in the weight ratio range of about 5:1 to 10:1.

The glass transition temperature of a polymer is the temperature below which it exhibits the physical properties of a solid rather than a viscous liquid. The glass transition temperatures of polymers and techniques for their measurement are generally known in the art and form no part of this invention. Reference books typically publish the glass transition temperatures for homopolymers of common polymerizable monomers. The glass transition temperatures of copolymers (polymers containing two or more types of repeating units) can be estimated from a knowledge of the proportion of each repeating unit making up the copolymer and the published glass transition temperature of the homopolymer corresponding to each repeating unit. Representative glass transition temperatures for homopolymers have been published, for example, in the *Polymer Handbook*, 2nd Ed., in the Chapter by W. A. Lee and R. A. Rutherford, titled, "The Glass Transition Temperature of Polymers", beginning at page III-139, John Wiley & Sons, N.Y., 1975, the disclosure of which is here incorporated by reference.

Any polymeric material having the requisite Tg may be used in the stress absorbing layer in the photographic elements of the invention. For example, there may be used the polymers disclosed in U.S. Pat. Nos. 3,576,628, 4,245,036, 4,247,627, 4,551,412, and 4,822,727 referred to above, and those disclosed in U.S. Pat. No. 4,855,219, which meet the Tg requirement. There may also be used the gel-grafted polymers disclosed in U.S. Pat. No. 4,920,004 and copending, commonly assigned U.S. Ser. No. 07/497,456, the disclosures of which are incorporated by reference. Preferred polymers include acrylic polymer latexes due to their compatability with most conventional photographic systems.

As employed herein the term "acrylate polymer" indicates a vinyl polymer having at least 50 percent by weight of its repeating units derived from one or more acrylate esters. The acrylate ester monomers forming the repeating units of the polymer can be conveniently provided by reacting acrylic acid with an alcohol, phenol, or hydroxy substituted ether. It is generally preferred to select individual repeating units of the acrylate polymer, including each acrylate ester or other, optional repeating unit present, from those containing up to about 21 carbon atoms. When the acrylate polymer is a copolymer, it is not essential that any one repeating unit present form a homopolymer having a glass transition temperature of less than 5° C., provided the copolymer as a whole satisfies this criterion.

In one simple embodiment of the invention the polymer is a homopolymer of an acrylic ester selected to exhibit a glass transition temperature of less than 5° C. Acrylic esters capable of forming homopolymers exhibiting a glass transition temperature of less than 5° C. are also preferred acrylate ester repeating units for the copolymers employed as latices in accordance with this invention.

In a preferred form the acrylate ester repeating unit unit is derived from a monomer satisfying Formula 4.

$$H_2C{=}CH{-}\overset{\overset{\displaystyle O}{\|}}{C}{-}O{-}R \qquad (4)$$

where

R is an ester forming moiety (e.g., the residue of an alcohol, phenol, or ether) containing from 2 to 10 carbon atoms, preferably from 2 to 6 carbon atoms. R can, for example, be any alkyl of from 2 to 10 carbon atoms; a benzyl group of from 7 to 10 carbon atoms, a cycloalkyl group of from 3 to 10 carbon atoms, preferably 5 to 7 carbon atoms; or a mono-oxy, di-oxy, or tri-oxy ether containing from 2 to 10 carbon atoms. Although the foregoing are preferred, it is appreciated that R in the various forms noted can contain up to about 18 carbon atoms when the repeating unit ranges up to 21 carbon atoms, as noted above.

Numerous other forms of the acrylate ester group are, of course, possible. Choice of a specific acrylate ester monomer is dictated by (1) the desired glass transition temperature of the acrylate polymer, (2) the proportion of the acrylate polymer the particular acrylate ester constitutes, and (3) the effect of other repeating units, if any, on the overall glass transition temperature of the acrylate polymer.

The acrylate ester monomers set forth in Table I are illustrative of readily available monomers contemplated for inclusion as repeating units of the acrylate polymers of the latices employed in stress absorbing layers to reduce pressure fog. Chemical Abstracts Service names and registry numbers are given where available.

Table I

Aa. 2-Propenoic acid, pentyl ester (2998-23-4)
Ab. 2-Propenoic acid, butyl ester (141-32-2)
Ac. 2-Propenoic acid, phenylmethyl ester (2495-35-4)
Ad. 2-Propenoic acid, cyclohexyl ester (3066-71-5)
Ae. 2-Propenoic acid, cyclopentyl ester (16868-13-6)
Af. 2-Propenoic acid, hexadecyl ester (13402-02-3)
Ag. 2-Propenoic acid, 2-methylpropyl ester (106-63-8)
Ah. 2-Propenoic acid, 2-ethylhexyl ester (103-11-7)
Ai. 2-Propenoic acid, 2-(1-ethyl)pentyl ester
Aj. 2-Propenoic acid, 2-(2-ethoxyethoxy)ethyl ester (7328-17-8)
Ak. 2-Propenoic acid, 2-butoxyethyl ester (7251-90-3)
Al. 2-Propenoic acid, 2-(2-methoxyethoxy)ethyl ester (7238-18-9)
Am. 2-Propenoic acid, 2-n-propyl-3-i-propylpropyl ester
An. 2-Propenoic acid, octyl ester (2499-59-4)
Ao. 2-Propenoic acid, octadecyl ester (4813-57-4)
Ap. 2-Propenoic acid, 2-ethoxyethyl ester (106-74-1)
Aq. 2-Propenoic acid, 2-methoxyethyl ester (3121-61-7)
Ar. 2-Propenoic acid, 2-(methoxyethoxy)ethyl ester (86242-25-3)
As. 2-Propenoic acid, ethyl ester (140-88-5)
At. 2-Propenoic acid, propyl ester (925-60-0)
Au. 2-Propenoic acid, 2-phenoxyethyl ester (48145-04-6)
Av. 2-Propenoic acid, phenyl ester (937-41-7)
Aw. 2-Propenoic acid, 1-methylethyl ester (689-12-3)
Ax. 2-Propenoic acid, hexyl ester (2499-95-8)
Ay. 2-Propenoic acid, 1-methylpropyl ester (2998-08-5)
Az. 2-Propenoic acid, 2,2-dimethylbutyl ester (13141-03-2)

It has been observed that acrylate polymers remain more uniformly dispersed in hydrophilic colloid vehicles during handling and storage when from about 1 to 10 percent, by weight, of the repeating units of the acrylate polymer contain at least one highly polar pendant group. These repeating units can be derived from any convenient vinyl monomer having at least one pendant highly polar group. These vinyl monomers can be selected from among those having from 2 to 21 carbon atoms, preferably 3 to 10 carbon atoms. Illustrative of vinyl monomers of this class are those satisfying Formula 5.

$$V-(L)_m-P \quad (5)$$

where

V is a group having a vinyl unsaturation site;

L is a divalent linking group;

m is the integer 1 or 0; and

P is a highly polar pendant group.

In one preferred form the highly polar pendant group can be a carboxylic acid or carboxylic acid salt moiety (e.g., an ammonium or alkali metal carboxylate). The pendant group in this form can satisfy the Formula 6.

$$-\overset{O}{\overset{\|}{C}}-O-M \quad (6)$$

where

M is hydrogen, ammonium, or an alkali metal.

The monomers set out in Table II are illustrative of those capable of providing repeating units of this type.

Table II

Ca. 1-Propene-1,2,3-tricarboxylic acid (499-12-7)
Cb. 2-Propenoic acid (79-10-7)
Cc. 2-Propenoic acid, sodium salt (7446-81-3)
Cd. 2-Chloro-2-propenoic acid (598-79-8)
Ce. 2-Propenoic acid, 2-carboxyethyl ester (24615-84-7)
Cf. 2-Methyl-2-propenoic acid (79-41-4)
Cg. 2-Methyl-2-propenoic acid, lithium salt (13234-23-6)
Ch. Methylenebutanedioic acid (97-65-4)
Ci. 2-Butenedioic acid (110-16-7)
Cj. 2-Methylbutenedioic acid (498-24-8)
Ck. 2-Methylenepentendioic acid (3621-79-2)

Generally regarded as more effective in imparting stabilization than the above class of pendant groups are sulfo or oxysulfo pendant groups. The pendant group in this form can satisfy the Formula 7.

$$-(O)_n-\overset{O}{\overset{\|}{\underset{\underset{O}{\|}}{S}}}-O-M \quad (7)$$

where

M is as previously defined and n is zero or 1.

The monomers set out in Table III are illustrative of those capable of providing repeating units of this type.

Table III

Sa. 2-Carboethoxyallyl sulfate, sodium salt
Sb. 2-Propenoic acid, ester with 4-hydroxy-1-butanesulfonic acid, sodium salt (13064-32-9)
Sc. 2-Propenoic acid ester with 4-hydroxy-2-butanesulfonic acid, sodium salt (15834-96-5)
Sd. 3-Allyloxy-2-hydroxypropanesulfonic acid, sodium salt
Se. 2-Methyl-2-propenoic acid ester with 3-[tert-butyl(2-hydroxyethyl)amino]propane sulfonic acid (14996-75-9)
Sf. Ethenesulfonic acid, sodium salt (3039-83-6)
Sg. Methylenesuccinic acid, diester with 3-hydroxy-1-propane sulfonic acid, disodium salt (21567-32-8)
Sh. 2 Methyl-2-propenoic acid ester with 2-(sulfooxy) ethyl, sodium salt (45103-52-4)
Si. N-3-Sulfopropyl acrylamide, potassium salt
Sj. 2-Methyl-2-propenoic acid, 2-sulfoethyl ester (10595-80-9)
Sk. 2-Methyl-2-propenoic acid, 2-sulfoethyl ester, lithium salt (52556-31-7)
Sl. o-Styrene sulfonic acid, ammonium salt
Sm. p-Styrene sulfonic acid, potassium salt (4551-90-0)
Sn. p-Styrene sulfonic acid
So. 4-4-Ethenylbenzenesulfonic acid, sodium salt (2695-37-6)
Sp. 2-Propenoic cid, 3-sulfopropyl ester, sodium salt (15717-25-6)
Sq. m-Sulfomethylstyrene sulfonic acid, potassium salt Sr. p-Sulfomethylstyrene sulfonic acid, sodium salt
Ss. 2-Methyl-2-propenoic acid, 3-sulfopropyl ester, sodium salt (10548-16-0)
St. 2-Methyl-2-propenoic acid, 3-sulfobutyl ester, sodium salt (64112-63-6)
Su. 2-Methyl-2-propenoic acid, 4-sulfobutyl ester, sodium salt (10548-15-9)
Sv. 2-Methyl-2-propenoic acid, 2-sulfoethyl ester, sodium salt (1804-87-1)
Sw. 2-Methyl-2-[(1-oxo-2-propenyl)amino]-1-propane sulfonic acid (15214-89-8)
Sy. 2-Methyl-2-[(1-oxo-2-propenyl)amino]-1-propane sulfonic acid, sodium salt (5165-97-9)
Sz. 2-Methyl-2-[(1-oxo-2-propenyl)amino]-1-propane sulfonic acid, potassium salt (52825-28-2)

In preparing hydrophilic colloid containing layers of photographic elements it is accepted practice to harden the hydrophilic colloid. This reduces the ingestion of water during processing, thereby decreasing layer swell and improving adherence of the layers to each other and the support. Conventional hardeners for the hydrophilic colloid containing layers of photographic elements are illustrated by *Research Disclosure*, Vol. 176, January 1978, Item 17643, Section X, and *Research Disclosure*, Vol. 308, December 1989, pp.993–1015, the disclosures of which are here incorporated by reference. Research Disclosure is published by Kenneth Mason Publications, Ltd., Emsworth, Hampshire P010 7DD, England. Acrylate polymer latices incorporated in the stress absorbing layers of the photographic elements of this invention need not be hardenable, since the polymer, unlike the colloid with which it is blended, is hydrophobic and therefore does not pick up water during processing. However, it is a common practice to include in latices employed in the hydrophilic colloid layers of photographic elements at least a minor amount of repeating units capable of providing hardening sites.

In one preferred form the acrylate polymers employed in the practice of this invention contain from about 5 to 20 percent by weight repeating units capable of providing hardening sites. Illustrative of vinyl monomers of this class are those satisfying Formula 8.

$$V—(L)_m—H \quad (8)$$

where

V is a group having a vinyl unsaturation site;
L is a divalent linking group;
m is the integer 1 or 0; and
H is a moiety providing a hardening site, such as an active methylene moiety, an aziridine or oxirane moiety, a primary amino moiety, or a vinyl precursor moiety.

Hardenable sites can take a variety of forms. In a very common form the repeating unit can contain a readily displaceable hydrogen, such as an active methylene site, created when a methylene group is positioned between two strongly electron withdrawing groups, typically between two carbonyl groups or between a carbonyl group and a cyano group. Since the primary amino groups of gelatin, widely employed as a photographic hydrophilic colloid, provide hardening sites, it is also contemplated to incorporate in the acrylate polymer to facilitate hardening repeating units that contain a primary amino group. Another approach to providing a hardening site is to incorporate a vinyl precursor moiety, such as a repeating unit that is capable of dehydrohalogenation in situ to provide a vinyl group. Monomers which at the time of polymerization contain two or more vinyl groups, such as divinylbenzene, are preferably avoided or minimized to reduce crosslinking of the acrylate polymer. Stated another way, acrylate polymers are preferred which prior to hardening are linear polymers. Moieties containing strained rings, such as aziridine and oxirane (ethylene oxide) rings, are also capable of providing active hardening sites.

The monomers set out in Table IV are illustrative of those capable of providing repeating units providing hardening sites.

Table IV

Ha. 2-Cyano-N-2-propenylacetamide (30764-67-1)
Hb. 2-Methyl-2-propenoic acid, 2-aminoethyl ester, hydrochloride (2420-94-2)
Hc. 2-Propenoic acid, 2-aminoethyl ester (7659-38-3)
Hd. N-Methacryloyl-N'-glycylhydrazine hydrochloride
He. 5-Hexene-2,4-dione (52204-69-0)
Hf. 5-Methyl-5-Hexene-2,4-dione (20583-46-4)
Hg. 2-Methyl-2-propenoic acid, 2-[(cyanoacetyl)-oxy]ethyl ester (21115-26-4)
Hh. 2-Propenoic acid, oxidranylmethyl ester (106-90-1) (106-90-2)
Hj. Acetoacetoxy-2,2-dimethylpropyl methacrylate
Hk. 3-Oxo-4-pentenoic acid, ethyl ester (224105-80-0)
Hl. N-(2-Aminoethyl)-2-methyl-2-propenamide, monohydrochloride (76259-32-0)
Hm. 3-oxo-butanoic acid, 2-[(2-methyl-1-oxo-2-propenyl)oxy]ethyl ester (21282-87-3)
Hn. 2-Propenamido-4-(2-chloroethylsulfonylmethyl)-benzene
Ho. 3-(2-ethylsulfonylmethyl)styrene
Hp. 4-(2-ethylsulfonylmethyl)styrene
Hq. N-(2-Amino-2-methylpropyl)-N'-ethenylbutanediamide (41463-58-5)
Hr. Propenamide (79-06-1)

Still other repeating units can be incorporated in the polymers of this invention, so long as the glass transition temperature of the polymer is maintained at less than 5° C. The other repeating units can be employed to adjust the glass transition temperature of the polymer or to adjust hydrophobicity or hydrophilicity for a specific application. Styrenic repeating units (including repeating units derived from styrene and styrene substituted by hydrogen displacement, such as halo and alkyl substituted styrene monomers) and acrylamides (including halo and alkyl substituted acrylamides (e.g., methacrylamides and N-hydroxyalkylacrylamides) are particularly contemplated. The styrenic repeating units necessarily contain at least 8 and preferably contain up to about 16 carbon atoms. The acrylamides and substituted acrylamides require only 2 carbon atoms and preferably contain up to about 10 carbon atoms, optimally up to about 6 carbon atoms.

The monomers set out in Table V are illustrative of simple repeating units that can be employed to modify the hydrophobicity of the polymers.

Table V

Oa. Styrene
Ob. (1-Methylethenyl)benzene (98-83-9)
Oc. 3-Chloromethylstyrene
Od. 4-Chloromethylstyrene
Oe. 3-Octadecyloxystyrene
Of. 4-Octadecyloxystyrene Og. N-(3-Hydroxyphenyl)-2-methyl-2-propenamide (14473-49-5)
Oh. 2-Propenoic acid, 2-hydroxethyl ester (818-61-1)
Oi. 2-Propenoic acid, 2-hydroxypropyl ester
Oj. N-(1-Methylethyl)-2-propenamide (2210-25-5)
Ok. 3-Ethenylbenzoic acid
Ol. 4-Ethenylbenzoic acid
Om. N-(2-Hydroxypropyl)-2-methyl-2-propenamide (21442-01-3)
On. N,2-Dimethyl-2-propenamide (3887-02-3)
Op. 2-Methyl-2-propenamide (79-39-0)
Oq. N-(2-Hydroxypropyl)-2-methyl-2-propenamide (21442-01-3)
Or. N-[2-hydroxy-1,1-bis(hydroxymethyl)ethyl]-2-propenamide (13880-05-2)
Os. N-(1,1-Dimethylethyl)--2-propenamide (107-58-4)
Ot. Acetic acid ethenyl ester (108-05-4)
Ou. 3-Methylstyrene
Ov. 4-Methylstyrene
Ow. N,N-dimethyl-2-propenamide (2680-03-7)

In addition to being selected to reduce pressure fog the polymers employed in the stress absorbing layers can also be used as carriers for hydrophobic emulsion addenda as disclosed in U.S. Pat. No. 4,247,627. A wide variety of hydrophobic photographic addenda that can be associated with the polymers are disclosed in *Research Disclosure*, Item 19551, cited above, the disclosure of which is here incorporated by reference.

While any conventional hydrophilic colloid peptizer or combination of peptizers can be employed in combination with one or more polymers selected to satisfy the glass transition temperature requirements, preferred hydrophilic colloids for use in the practice of this invention are gelatino-peptizers, e.g., gelatin and modified gelatin (also referred to as gelatin derivatives). Useful hydrophilic colloid peptizers including gelatino-peptizers are disclosed in *Research Disclosure*, (cited above), Item 17643, Section IX, Paragraph A, here incorporated by reference. Of the various modified forms of gelatin, acetylated gelatin and phthalated gelatin constitute preferred gelatin derivatives. Specific useful forms of gelatin and gelatin derivatives can be chosen from among those disclosed by Yutzy et al U.S. Pat. Nos. 2,614,928 and 2,614,929; Lowe et al U.S. Pat. Nos. 2,614,930 and 2,614,931; Gates U.S. Pat. Nos. 2,787,545 and 2,956,880; Ryan U.S. Pat. No. 3,186,846; Dersch et al U.S. Pat. No. 3,436,220; Luciani et al U.K. Patent 1,186,790; and Maskasky U.S. Pat. No. 4,713,320.

In addition to a stress absorbing layer positioned between the support and a light sensitive emulsion layer, the photographic elements of the invention may include conventional protective outermost gelatin overcoat layers. The protective outermost overcoat layers may similarly comprise any conventional hydrophilic colloid peptizer or combination of hydrophilic colloids. Preferred hydrophilic colloids for use in the outermost overcoat layer include those listed above for use in the stress absorbing layer. The overcoat and stress absorbing layers may additionally contain any further addenda commonly employed in photographic layers, e.g. unsensitized silver halide emulsion, finely divided silver, soluble and fixed light absorbing dyes, solid particle dye dispersions, couplers, and other photographically useful species.

While the stress absorbing layer of the invention must contain a low Tg polymer in order to achieve the benefit of increased resistance to pressure fog, higher (e.g., above 5° C.) Tg polymers may also be present in the elements of the invention for other purposes. For example, the stress absorbing layers of the invention may additionally include a polymer with a relatively higher Tg in order to further improve the dry scratch resistance of photographic elements which include such stress absorbing layers.

In addition to at least one emulsion layer and at least one stress absorbing layer satisfying the requirements of the invention, the photographic elements include a support onto which the other layers are coated. Any convenient conventional photographic support can be employed. Useful photographic supports include film and paper supports. Illustrative photographic supports are disclosed in Research Disclosure, (cited above), Item 17643, Section XVII, here incorporated by reference.

Apart from the features specifically noted the photographic elements of this invention can employ any of the features characteristically included in color (including especially full multicolor) photographic elements which produce dye images and photographic elements which produce silver images, such as black-and-white photographic elements, graphic arts photographic elements, and radiographic elements intended to produce images by direct X-radiation exposure or by intensifying screen exposure. The emulsion and other layer features characteristic of photographic elements of these types are summarized in the remaining sections of *Research Disclosure*, Item 17643, cited above, and here incorporated by reference.

The photographic elements of the invention include those of the type previously described in the art, for example, as disclosed at *Research Disclosure*, 308, p. 933–1014 (1989). The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions although other hydrophilic colloids are useful. In a preferred embodiment of the invention, the stress absorbing layers of the invention are used in combination with tabular grain light sensitive silver halide emulsions.

As employed herein the term "tabular grain emulsion" designates any emulsion in which at least 50 percent of the total grain projected area is accounted for by tabular grains. Whereas tabular grains have long been recognized to exist to some degree in conventional emulsions, only recently has the photographically advantageous role of the tabular grain shape been appreciated.

The recent tabular grain emulsions have been observed to provide a large variety of photographic advantages, including, but not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflectance as a function of grain thickness, and reduced susceptibility to background radiation damage in very high speed emulsions.

While the recent tabular grain emulsions have advanced the state of the art in almost every grain related parameter of significance in silver halide photography, one area of concern has been the susceptibility of tabular grain emulsions to pressure fog resulting from the application of localized pressure on the grains. As such, the present invention is particularly applicable to photographic elements containing such tabular grain emulsions.

Tabular grain emulsions exhibiting particularly advantageous photographic properties include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1. Thin, intermediate aspect ratio tabular grain emulsions are those in which the tabular grains have a thickness of less than 0.2 μm and an average aspect ratio in the range of from 5:1 to 8:1. Such emulsions are disclosed by Wilgus et al U.S. Pat. No. 4,434,226; Daubendiek et al U.S. Pat. No. 4,414,310; Wey U.S. Pat. No. 4,399,215; Solberg et al U.S. Pat. No. 4,433,048; Mignot U.S. Pat. No. 4,386,156; Evans et al U.S. Pat. No. 4,504,570; Maskasky U.S. Pat. No. 4,400,463, Wey et al U.S. Pat. No. 4,414,306, Maskasky U.S. Pat. Nos. 4,435,501 and 4,643,966, and Daubendiek et al U.S. Pat. Nos. 4,672,027 and 4,693,964. The silver halide emulsions can be either monodisperse or polydisperse as precipitated. The grain size distribution of the emulsions can be controlled by techniques of separation and blending of silver halide grains of different types and sizes, including tabular grains, as previously described in the art.

The common feature of high aspect ratio and thin, intermediate aspect ratio tabular grain emulsions, hereinafter collectively referred to as "recent tabular grain emulsions", is that tabular grain thickness is reduced in relation to the equivalent circular diameter of the tabular grains. Most of the recent tabular grain emulsions can be differentiated from those known in the art for many years by the following relationship:

$$ECD/t^2 \geqq 25 \quad (1)$$

where

ECD is the average equivalent circular diameter of the tabular grains and t is the average thickness of the tabular grains.

The term "equivalent circular diameter" is employed in its art recognized sense to indicate the diameter of a circle having an area equal to that of the projected area of a grain, in this instance a tabular grain. All tabular grain averages referred to are to be understood to be number averages, except as otherwise indicated.

Since the average aspect ratio of a tabular grain emulsion satisfies relationship (2):

$$AR = ECD/t \quad (2)$$

where

AR is the average tabular grain aspect ratio and

ECD and t are as previously defined, it is apparent that relationship (1) can be alternatively written as relationship (3):

$$AR/t \geqq 25 \quad (3)$$

Relationship (3) makes plain the importance of both average aspect ratios and average thicknesses of tabular grains in arriving at preferred tabular grain emulsions having the most desirable photographic properties.

EXAMPLES

The following examples are provided to further illustrate the invention.

EXAMPLE 1

A color photographic recording material (Photographic Sample 101) for color negative development was prepared by applying the following layers in the given sequence to a transparent support of cellulose triacetate. The quantities of silver halide are given in grams of silver per $m^2$. The quantities of other materials are given in $g/m^2$. All silver halide emulsions were stabilized with 2 grams of 4-hydroxy-6-methyl-1,3,3a,7-tetraazaindene per mole of silver. Compounds M-1, M-2 and D-2 were used as emulsions containing tricresylphosphate. Compounds C-1, C-2, Y-1 and D-3 were used as emulsions containing di-n-butyl phthalate. Compound D-1 was used as an emulsion containing N-n-butyl acetanalide. Compounds UV-1 and UV-2 were used as emulsions containing 1,4-cyclohexylenedimethylene bis-(2-ethoxyhexanoate).

Layer 1 (Antihalation Layer) black colloidal silver sol containing 0.215 g of silver, dye UV-1 at 0.075 g, dye MD-1 at 0.038 g, dye CD-2 at 0.054 g, MM-2 at 0.13 g, scavenger S-1 at 0.16 g with 1.61 g gelatin.

Layer 2 (Interlayer) Oxidized developer scavenger S-1 at 0.11 g and 0.65 g of gelatin.

Layer 3 (First Red-Sensitive Layer) Red sensitized silver iodobromide tabular grain emulsion (3.8 mol % iodide, average grain diameter 0.6 microns) at 0.75 g, cyan dye-forming image coupler C-1 at 0.70 g, DIR compound D-7 at 0.016, cyan dye-forming masking coupler CM-1 at 0.027 g with gelatin at 1.72 g.

Layer 4 (Second Red-Sensitive Layer) Red sensitized silver iodobromide tabular grain emulsion (4 mol % iodide, average grain diameter 1.3 microns) at 0.97 g, cyan dye-forming image coupler C-2 at 0.14 g, DIR compound D-9 at 0.005 g, DIR compound D-7 at 0.022, cyan dye-forming masking coupler CM-1 at 0.016 g with gelatin at 1.51 g.

Layer 5 (Third Red-Sensitive Layer) Red sensitized silver iodobromide tabular grain emulsion (4 mol % iodide, average grain diameter 2 microns) at 0.97 g, cyan dye-forming image coupler C-2 at 0.13 g, DIR compound D-7 at 0.022 g, cyan dye-forming masking coupler CM-1 at 0.016 g with gelatin at 1.4 g.

Layer 6 (Layer) Oxidized developer scavenger S-1 at 0.16 g and 0.65 g of gelatin.

Layer 7 (First Green-Sensitive Layer) Green sensitized silver iodobromide tabular grain emulsion (4 mol % iodide, average grain diameter 0.65 microns) at 0.75 g, magenta dye-forming image coupler M-1 at 0.16 g, magenta dye-forming coupler M-2 at 0.16 g, DIR compound D-4 at 0.018 g, magenta dye-forming masking coupler MM-1 at 0.037 g, with gelatin at 1.51 g.

Layer 8 (Second Green-Sensitive Layer) Green sensitized silver iodobromide tabular grain emulsion (4 mol % iodide, average grain diameter 1.4 microns) at 0.97 g, magenta dye-forming image coupler M-1 at 0.054 g, magenta dye-forming image coupler M-2 at 0.054 g, DIR compound D-4 at 0.022 g, magenta dye-forming masking coupler MM-1 at 0.015 g, with gelatin at 1.67 g.

Layer 9 (Third Green-Sensitive Layer) Green sensitized silver iodobromide tabular grain emulsion (4 mol % iodide, average grain diameter 1.7 microns) at 0.97 g, magenta dye-forming image coupler M-1 at 0.038 g, magenta dye-forming image coupler M-2 at 0.038 g, magenta dye-forming masking coupler MM-1 at 0.011 g, DIR compound D-4 at 0.012 g, with gelatin at 1.4 g.

Layer 10 (Interlayer) Oxidized developer scavenger S-1 at 0.16 g, dye YD-2 at 0.13 g with 1.08 g of gelatin.

Layer 11 (First Blue-Sensitive Layer) Blue sensitized silver iodobromide tabular grain emulsion (3.6 mol % iodide, average grain diameter 0.9 microns, at 0.43 g, blue sensitized silver iodobromide tabular grain emulsion (3.8 mol % iodide, average grain diameter 1.5 microns) at 0.27 g, yellow dye-forming image coupler Y-2 at 1.08 g, DIR compound D-3 at 0.032 g, compound B-2 at 0.032 g with gelatin at 2.47 g.

Layer 12 (Second Blue-Sensitive Layer) Blue sensitized silver iodobromide tabular grain emulsion (3 mol % iodide, average grain diameter 3.3 microns, at 0.75 g, yellow dye-forming image coupler Y-2 at 0.22 g, DIR compound D-3 at 0.032 g, with gelatin at 1.72 g.

Layer 13 (Protective Layer 1) 0.108 g of dye UV-1, 0.118 g of dye UV-2, unsensitized silver bromide Lippman emulsion at 0.108 g, with gelatin at 1.08 g.

Layer 14 (Protective Layer 2) Anti-matte polymethylmethacrylate beads at 0.0538 g with gelatin at 0.75 g.

This film was hardened at coating with 2% by weight to total gelatin of conventional hardner H-1 (bis(vinylsulfonyl) methane). Surfactants, coating aids, scavengers, soluble absorber dyes and stabilizers were added to the various layers of this sample as is commonly practiced in the art.

Photographic Sample 102 was like Photographic Sample 101 except that 1.29 g of Polymer Latex A and 0.11 g of Polymer Latex C were both added to layer 11.

Photographic Sample 103 was like Photographic Sample 101 except that 1.29 g of Polymer Latex A and 0.11 g of Polymer Latex C were both added to layer 13.

Photographic Sample 104 was like Photographic Sample 101 except that 1.29 g of Polymer Latex A and 0.11 g of Polymer Latex C were both added to layer 10.

Polymeric latexes employed in Example 1 are described below. Component monomers, relative proportions and polymer Tg in degrees Centigrade are listed.

Polymer Latex A: n-Butyl acrylate/2-acrylamido-2-methylpropane sulfonic acid/2-acetoacetoxyethyl methacrylate—(88:5:7)—Tg = −28° C.

Polymer Latex C: Methyl Acrylate/2-acrylamido-2-methylpropane sulfonic acid/2-acetoacetoxyethyl methacrylate—(91:5:4)—Tg = +10.5° C.

Structures for various compounds used in the above samples are given below.

B-1

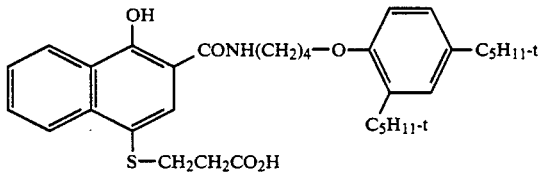

B-2

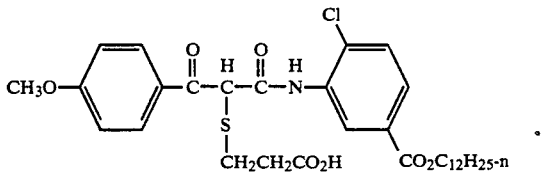

C-1

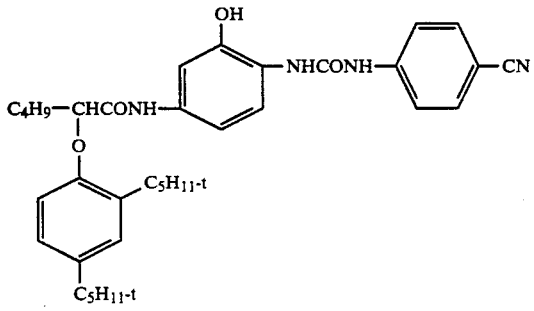

-continued
C-2
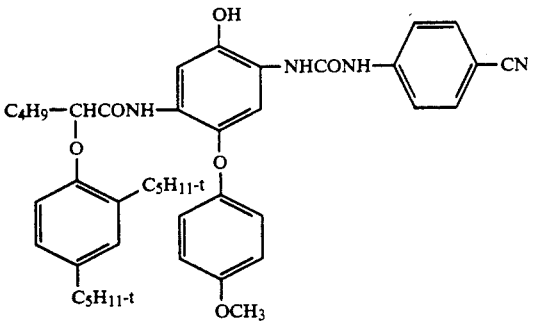
CD-2
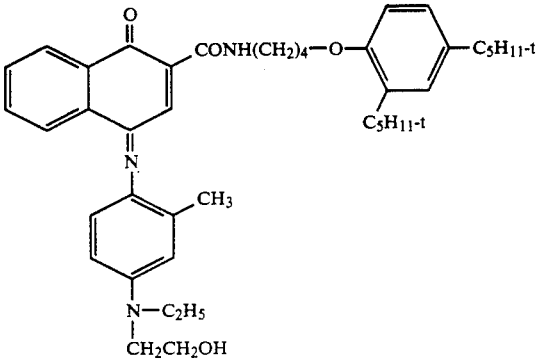
CM-1
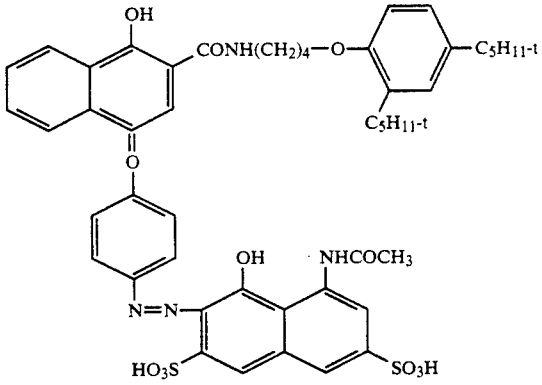
D-1
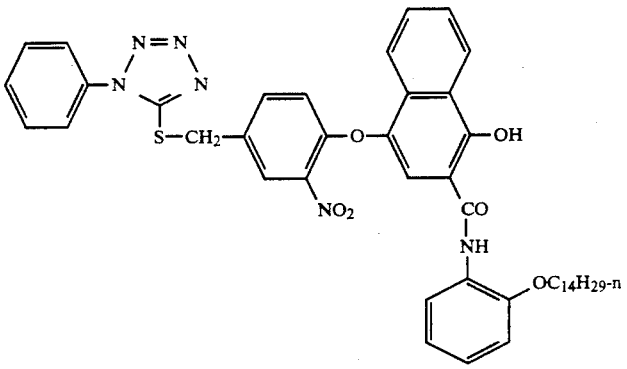

-continued
D-2
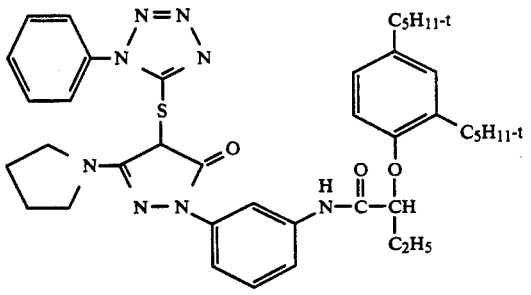
D-3
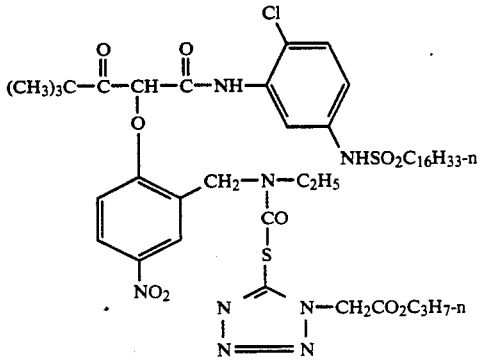
D-4
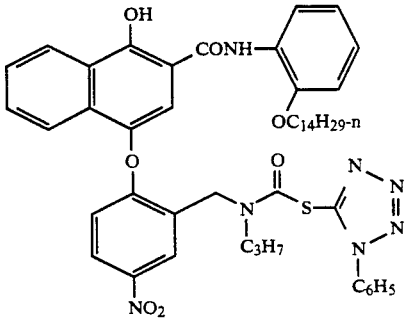
D-7
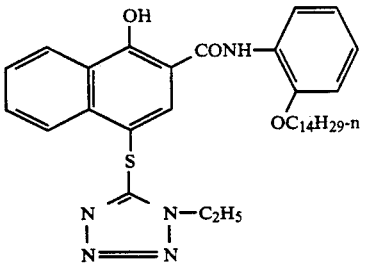
D-9
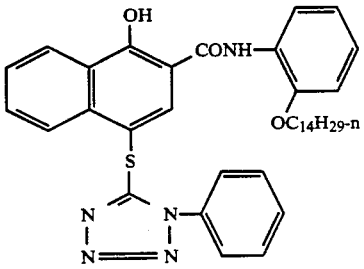

-continued
D-10
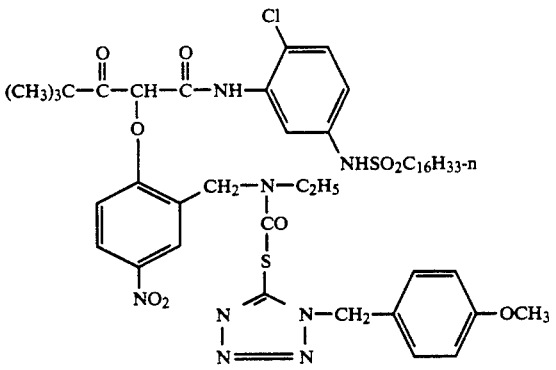
M-1
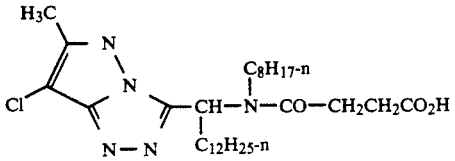
M-2
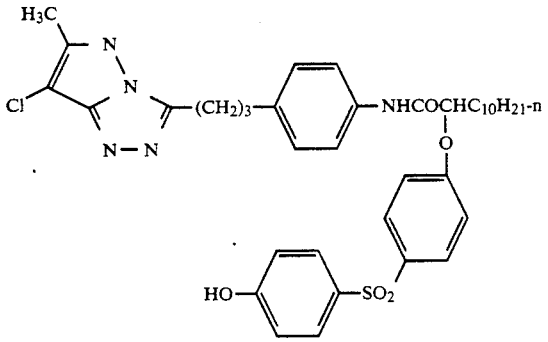
MD-1
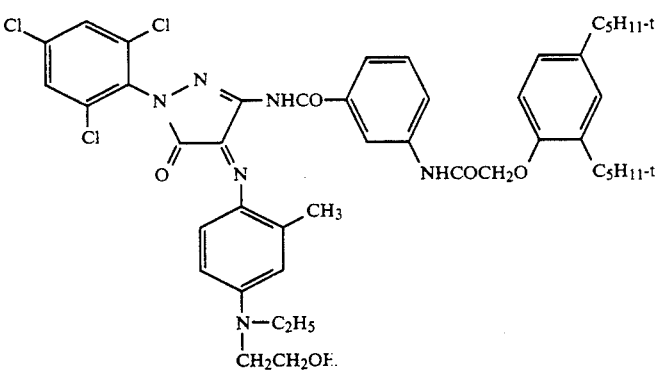
MM-1
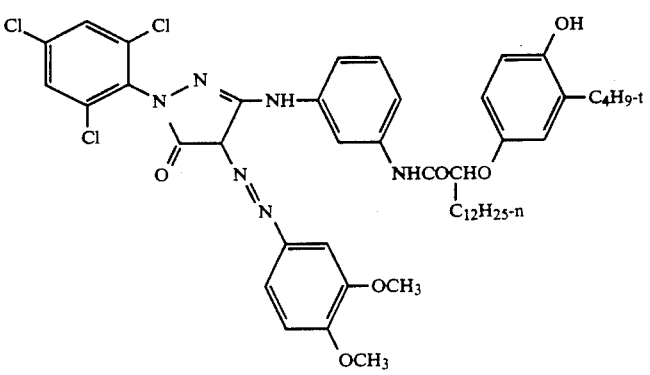

-continued
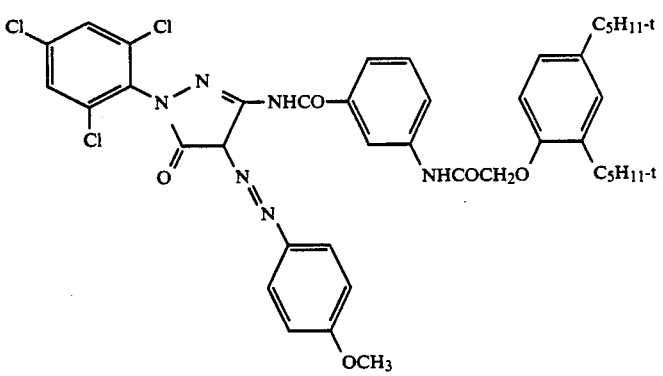
MM-2
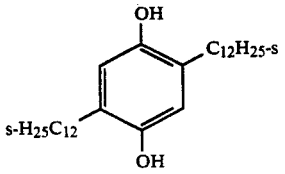
S-1
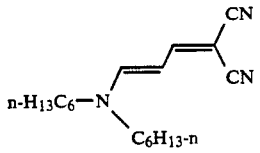
UV-1
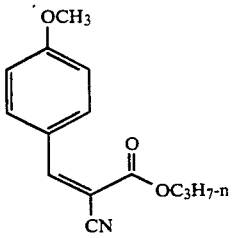
UV-2
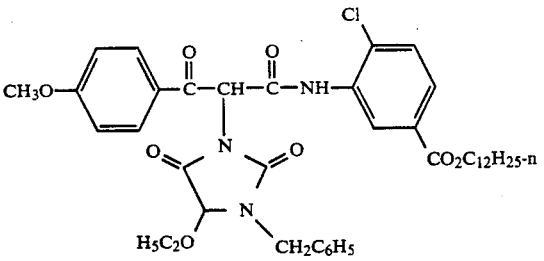
Y-1
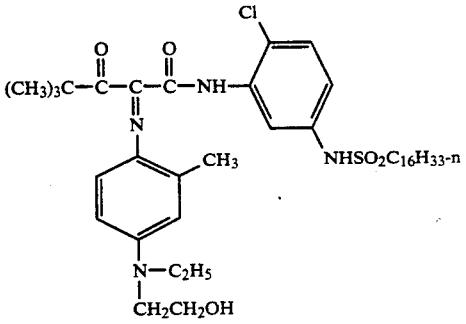
YD-1

-continued

YD-2

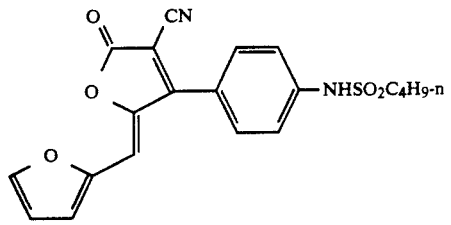

The pressure sensitivity of Photographic Samples 101 through 104 was evaluated by subjecting portions of each sample to 42psi pressure in a roller apparatus fitted with a sandblasted hardened steel wheel. The indentations and ridges on the sandblasted wheel mimic the effect of dirt particles or other imperfections on, for example, camera transport mechanisms.

Both pressured and unpressured portions of each sample were exposed to white light through a grey wedge chart. These samples were then developed using a color negative process, the KODAK C-41 process, as described in the British Journal of Photography Annual of 1988, pp. 196–198 (KODAK is a trademark of the Eastman Kodak Company, U.S.A.).

The magnitude of the pressure effect was quantified by comparing the blue Dmin density of an unpressured portion of a sample to that of a pressured portion of the same sample. The increase in density observed with the pressured portion of a sample is the pressure-fog. Smaller values of the pressure-fog are superior in that they indicate that a particular film composition is less susceptible to forming unsightly marks and blemishes due, for example, to dirt or to imperfections in film transport apparatus. This results in improved quality for prints made from such a color negative film.

The scratch resistance of Photographic Samples 101 through 104 was evaluated by contacting either a dry sample (DRY) or a sample swollen in developer solution (WET) with a variably loaded sapphire stylus and determining the load required (in grams) to form a visible scratch or plow mark. Samples requiring a larger load are more scratch resistant.

The results of these tests are shown in Table VI. For each sample, the pressure-fog is listed both as the increase in Status M blue density and as the percent increase in blue density relative to that of the control sample. The DRY SCRATCH TEST and WET SCRATCH TEST results are also listed (values are in grams). Additionally, the identity and quantity of the polymer latex used as a pressure-protective material is listed as well as the layer to which it is added.

TABLE VI

Pressure Sensitivity and Scratch Resistance of Photographic Samples.

| Sample | Pressure-Fog +D | Pressure-Fog % + D | Scratch Test Dry | Scratch Test Wet | Protective Component Added Layer | Protective Component Added Identity | Protective Component Added Quantity |
|---|---|---|---|---|---|---|---|
| 101 | 0.47 | 100 | >100 | 101 | — | — | 0.0 |
| 102 | 0.48 | 102 | >100 | 103 | 11 | A + C | 1.4 |
| 103 | 0.24 | 50 | 47 | 95 | 13 | A + C | 1.4 |
| 104 | 0.37 | 79 | >100 | 120 | 10 | A + C | 1.4 |

As can be readily appreciated on examination of the experimental data presented in Table VI, the samples incorporating the inventive compositions enable both lower sensitivity to pressure and improved dry and wet scratch resistance when compared to samples incorporating no polymer latex or when compared to samples incorporating similar quantities of polymer latex in other positions or in silver halide layers.

EXAMPLE 2

Photographic Sample 201 was prepared like Photographic Sample 101 by applying the following layers in the given sequence to a transparent support of cellulose triacetate. Layer 1 (Antihalation Layer) black colloidal silver sol containing 0.323 g of silver, dye UV-1 at 0.075 g, dye MD-1 at 0.016 g, dye CD-2 at 0.027 g, MM-2 at 0.17 g with 2.44 g gelatin. Layer 2 (First Red-Sensitive Layer) Red sensitized silver iodobromide tabular grain emulsion (4 mol % iodide, average grain diameter 0.8 microns) at 0.27 g, red sensitized silver iodobromide emulsion (4 mol % iodide, average grain diameter 1.3 microns, average grain thickness 0.1 micron) at 0.16 g, cyan dye-forming image coupler C-2 at 0.48 g, DIR compound D-1 at 0.003 g, DIR compound D-7 at 0.011 BAR compound B-1 at 0.032 g, with gelatin at 1.61 g.

Layer 3 (Second Red-Sensitive Layer) Red sensitized silver iodobromide tabular grain emulsion (4.2 mol % iodide, average grain diameter 2.1 microns) at 0.48 g, cyan dye-forming image coupler C-2 at 0.17 g, DIR compound D-7 at 0.011 g, DIR compound D-1 at 0.007 g BAR compound B-1 at 0.011 g, cyan dye-forming masking coupler CM-1 at 0.032 g with gelatin at 1.29 g. Layer 4 (Interlayer) Oxidized developer scavenger S-1 at 0.054 g and 1.61 g of gelatin. Layer 5 (Interlayer) Oxidized developer scavenger S-1 at 0.108 g and 1.08 g of gelatin.

Layer 6 (Green-Sensitive Layer) Green sensitized silver iodobromide tabular grain emulsion (4 mol % iodide, average grain diameter 0.65 microns) at 0.32 g, green sensitized silver iodobromide emulsion (4 mol % iodide, average grain diameter 1.5 microns, average thickness 0.09 microns) at 0.32 g, green sensitized silver iodobromide emulsion (4.2 mol % iodide, average grain diameter 2.3 microns, average grain thickness 0.09 microns) at 0.44 g, magenta dye-forming image coupler M-1 at 0.16 g, magenta dye-forming image coupler M-2 at 0.27 g, DIR compound D-1 at 0.015 g, DIR compound D-2 at 0.009 g, magenta dye-forming masking coupler MM-1 at 0.037 g, with gelatin at 2.69 g.

Layer 7 (Interlayer) Oxidized developer scavenger S-1 at 0.108 g, yellow colloidal silver at 0.038 g with 1.08 g of gelatin.

Layer 8 (Blue-Sensitive Layer) Blue sensitized silver iodobromide emulsion tabular grain (4 mol % iodide, average grain diameter 0.9 microns) at 0.33 g, blue sensitized silver iodobromide emulsion (4 mol % iodide, average grain diameter 1.5 microns, average grain thickness 0.09 micron) at 0.22 g, blue sensitized silver iodobromide emulsion (3 mol % iodide, average grain diameter 3.3 microns, average grain thickness 0.12 microns) at 0.75 g, yellow dye-forming image coupler Y-1 at 0.86 g, DIR compound D-3 at 0.053 g, compound B-2 at 0.022 g with gelatin at 2.15 g.

Layer 9 (Protective Layer) at 0.108 g of dye UV-1, 0.118 g of dye UV-2, unsensitized silver bromide Lippman emulsion at 0.108 g, anti-matte polymethylmethacrylate beads at 0.0538 g with gelatin at 1.6 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Sample 202 was like Photographic Sample 201 except that 0.81 g of Polymer Latex A was added to each of layers 6 and 8.

Photographic Sample 203 was like Photographic Sample 201 except that 1.61 g of Polymer Latex A was added to layer 9.

Photographic Sample 204 was like Photographic Sample 201 except that 0.81 g of Polymer Latex A was added to each of layers 7 and 9.

Photographic Sample 205 was like Photographic Sample 201 except that 1.61 g of Polymer Latex A was added to layer 7.

The pressure sensitivity of Photographic Samples 201 through 205 was evaluated in a manner like that described for Photographic Samples 101 through 104. These results are shown in Table VII.

TABLE VII

| | Pressure Sensitivity of Photographic Samples | | | | |
|---|---|---|---|---|---|
| | Pressure-Fog | | Protective Component Added | | |
| Sample | +D | % + D | Layer | Identity | Quantity |
| 201 | 0.72 | 100 | — | — | 0.0 |
| 202 | 0.72 | 100 | 6 & 8 | A | 1.6 |
| 203 | 0.49 | 68 | 9 | A | 1.6 |
| 204 | 0.56 | 78 | 7 & 9 | A | 1.6 |
| 205 | 0.49 | 68 | 7 | A | 1.6 |

As can be readily appreciated on examination of the experimental data presented in Table VII, the samples of the inventive compositions enable lower sensitivity to pressure when compared to samples incorporating no polymer latex or when compared to samples incorporating similar quantities of polymer latex in silver halide layers.

The invention has been described in detail with particular reference to preferred embodiments thereof, but it will be understood that variations and modifications can be effected within the spirit and scope of the invention.

We claim:

1. A light sensitive photographic element comprising a support bearing at least one light sensitive silver halide emulsion layer and at least one non-light sensitive stress absorbing layer between the emulsion layer and the support, wherein the stress absorbing layer comprises a polymer latex and hydrophilic colloid in a mass ratio greater than or equal to about 1:2, the polymer latex having a glass transition temperature of less than about 5° C.

2. The element of claim 1 wherein the polymer latex and hydrophilic colloid in the stress absorbing layer are present in a mass ratio of from about 1:1 to 10:1.

3. The element of claim 1 wherein the polymer latex and hydrophilic colloid in the stress absorbing layer are present in a mass ratio of from about 2:1 to 10:1.

4. The element of claim 1 wherein the polymer latex and hydrophilic colloid in the stress absorbing layer are present in a mass ratio of from about 5:1 to 10:1.

5. The element of claim 1 wherein the polymer latex has a glass transition temperature of less than about 0° C.

6. The element of claim 1 wherein the polymer latex has a glass transition temperature of less than about −15° C.

7. The element of claim 1, 2, 3, 4, 5, or 6 wherein the polymer latex comprises an acrylic polymer latex.

8. The element of claim 1, 2, 3, 4, 5, or 6 wherein the light sensitive silver halide emulsion layer comprises a tabular grain silver halide emulsion.

9. The element of claim 1 further comprising a protective layer comprising gelatin on the opposite side of said emulsion layer relative to said support.

* * * * *